US010721964B2

(12) United States Patent
Eng et al.

(10) Patent No.: US 10,721,964 B2
(45) Date of Patent: Jul. 28, 2020

(54) ELECTRONIC HOOKAH APPARATUS

(71) Applicants: Ryan L. Eng, East Brunswick, NJ (US); Eric Wong, East Brunswick, NJ (US)

(72) Inventors: Ryan L. Eng, East Brunswick, NJ (US); Eric Wong, East Brunswick, NJ (US)

(73) Assignee: NGEN SMOKE LLC, East Brunswick, NJ (US)

( * ) Notice: Subject to any disclaimer, the term of this patent is extended or adjusted under 35 U.S.C. 154(b) by 422 days.

(21) Appl. No.: 15/000,534

(22) Filed: Jan. 19, 2016

(65) Prior Publication Data

US 2016/0206001 A1 Jul. 21, 2016

Related U.S. Application Data

(60) Provisional application No. 62/105,077, filed on Jan. 19, 2015.

(51) Int. Cl.
*A24F 47/00* (2020.01)
*A24F 1/30* (2006.01)

(52) U.S. Cl.
CPC ..... *A24F 47/008* (2013.01); *A24F 1/30* (2013.01)

(58) Field of Classification Search
CPC ..... A24F 47/008; A24F 1/30
USPC ..... 392/390, 397, 399; 128/200.14, 203.17
See application file for complete search history.

(56) References Cited

U.S. PATENT DOCUMENTS 8,757,170 B2 * 6/2014 Kaplani ..... A24F 1/30 131/194
2014/0366898 A1 * 12/2014 Monsees ..... A24F 47/008 131/329

* cited by examiner

*Primary Examiner* — Tu B Hoang
*Assistant Examiner* — Thomas J Ward
(74) *Attorney, Agent, or Firm* — Antonio Papageorgiou; Meister Seelig & Fein LLP

(57) ABSTRACT

An electronic hookah apparatus comprising a core unit attachable with a stem piece and a base. The core comprises at least one airflow sensor to detect airflow from air pathways, a plurality of cartridges including a wick and a heating element, and a plurality of flavor selection buttons, each of the flavor selection buttons connected to a switch that activates and deactivates a respective one of the plurality of cartridges. The core further comprises a microcontroller that provides power to cartridges activated by the flavor selection buttons based on the detection of airflow by the airflow sensor, wherein providing power to the cartridges causes the cartridges to produce vapor, at least one air chamber that collects flows of vapor from a set of activated cartridges, and at least one hose port coupled to a hose, the at least one hose port tapping the collected vapor from the at least one air chamber.

10 Claims, 6 Drawing Sheets

ELECTRONIC HOOKAH APPARATUS

CROSS REFERENCE TO RELATED APPLICATION

This application claims the priority of U.S. Provisional Application No. 29/514,974, entitled "ELECTRONIC HOOKAH APPARATUS," filed on Jan. 19, 2015, the disclosure of which is hereby incorporated by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Field of the Invention

The invention described herein generally relates to an electronic smoking product, and in particular, an electronic hookah apparatus.

Description of the Related Art

A hookah is typically a single or multi-stemmed instrument for smoking tobacco, whereby the vapor or smoke is passed through a water basin before inhalation. Traditional hookahs utilize flavored tobacco products as the primary smoking product and can usually only burn one flavor or type of tobacco at a time. The type of smoke to be produced cannot be changed easily at any time during use, without finishing or prematurely disposing of the previous smoking material. Individual smokers who are using the hookah simultaneously cannot each choose a different type and/or flavor of smoke. There is thus a need for an electronic smoke-producing mechanism in place of a traditional hookah that provides advantages to the individual smoker and to the overall social experience.

SUMMARY OF THE INVENTION

The present invention provides an electronic hookah apparatus and a method for controlling vapor in an electronic hookah device. According to one embodiment, the electronic hookah apparatus comprises a core unit attachable with a stem piece and a base. The core comprises at least one airflow sensor to detect airflow from air pathways, a plurality of cartridges including a wick and a heating element, and a plurality of flavor selection buttons, each of the flavor selection buttons connected to a switch that activates and deactivates a respective one of the plurality of cartridges. The core further comprises a microcontroller that provides power to cartridges activated by the flavor selection buttons based on the detection of airflow by the airflow sensor, wherein providing power to the cartridges causes the cartridges to produce vapor, at least one air chamber that collects flows of vapor from a set of activated cartridges, and at least one hose port coupled to a hose, the at least one hose port tapping the collected vapor from the at least one air chamber.

The core unit may further include programmable light emitting diodes (LEDs) controlled by the microcontroller. In one embodiment, the microcontroller may cause the LEDs to increase in brightness from an initial brightness based on the detection of airflow by the airflow sensor, and causes the LEDs to return to the initial brightness based on a detection of the airflow ceasing. According to another embodiment, the microcontroller may cause the LEDs to intermittently dim and brighten after a predetermined amount of time based on an identification of no airflow by the airflow sensor. The microcontroller can control and vary voltages supplied to each of the plurality of cartridges to change intensity of vapor from each of the plurality of cartridges. The microcontroller may also limit duration of time that power is supplied to the plurality of cartridges. According to one or more embodiments, the electronic hookah apparatus further includes a battery unit. The electronic hookah apparatus may also include a power connection that supplies power to the electronic hookah apparatus from a direct power source.

According to another embodiment, an electronic smoking device comprises a plurality of cartridges including a wick and a heating element, a plurality of flavor selection buttons, each of the flavor selection buttons connected to a switch that activates and deactivates heating of a respective one of the plurality of cartridges to causes the cartridge to produce vapor, at least one air chamber that collects flows of vapor from a set of activated cartridges; and at least one outlet coupled to the at least one air chamber configured to receive the collected vapor from the at least one air chamber.

The electronic smoking device may further include an electronic control configured to vary voltages supplied to each of the plurality of cartridges to change intensity of vapor from each of the plurality of cartridges. In certain embodiments, the electronic smoking device comprises a device selected from the group consisting of a pen, pipe, and bong.

In one embodiment, the method for controlling vapor in an electronic smoking device comprises detecting at least one signal associated with a selection of at least one of a plurality of flavor selection buttons on the electronic smoking device, activating each respective cartridge associated with the selection of at least one of a plurality of flavor selection buttons, and providing heat to each of the activated cartridges to cause the cartridge to produce vapor, wherein vapor from each of the activated cartridges are collected in an air chamber.

The method may further comprise electronically varying voltages supplied to each of the plurality of cartridges to change intensity of vapor from each of the plurality of cartridges. One embodiment further comprises electronically controlling programmable LEDs of the electronic smoking device. The LEDs may be controlled to increase in brightness from an initial brightness based on a detection of usage of the electronic smoking device and return to the initial brightness based on a detection of non-usage of the electronic smoking device. The LEDs may be further controlled to intermittently dim and brighten after a predetermined amount of time.

BRIEF DESCRIPTION OF THE DRAWINGS

The invention is illustrated in the figures of the accompanying drawings which are meant to be exemplary and not limiting, in which like references are intended to refer to like or corresponding parts, and in which.

DETAILED DESCRIPTION OF THE INVENTION

Figure 1:
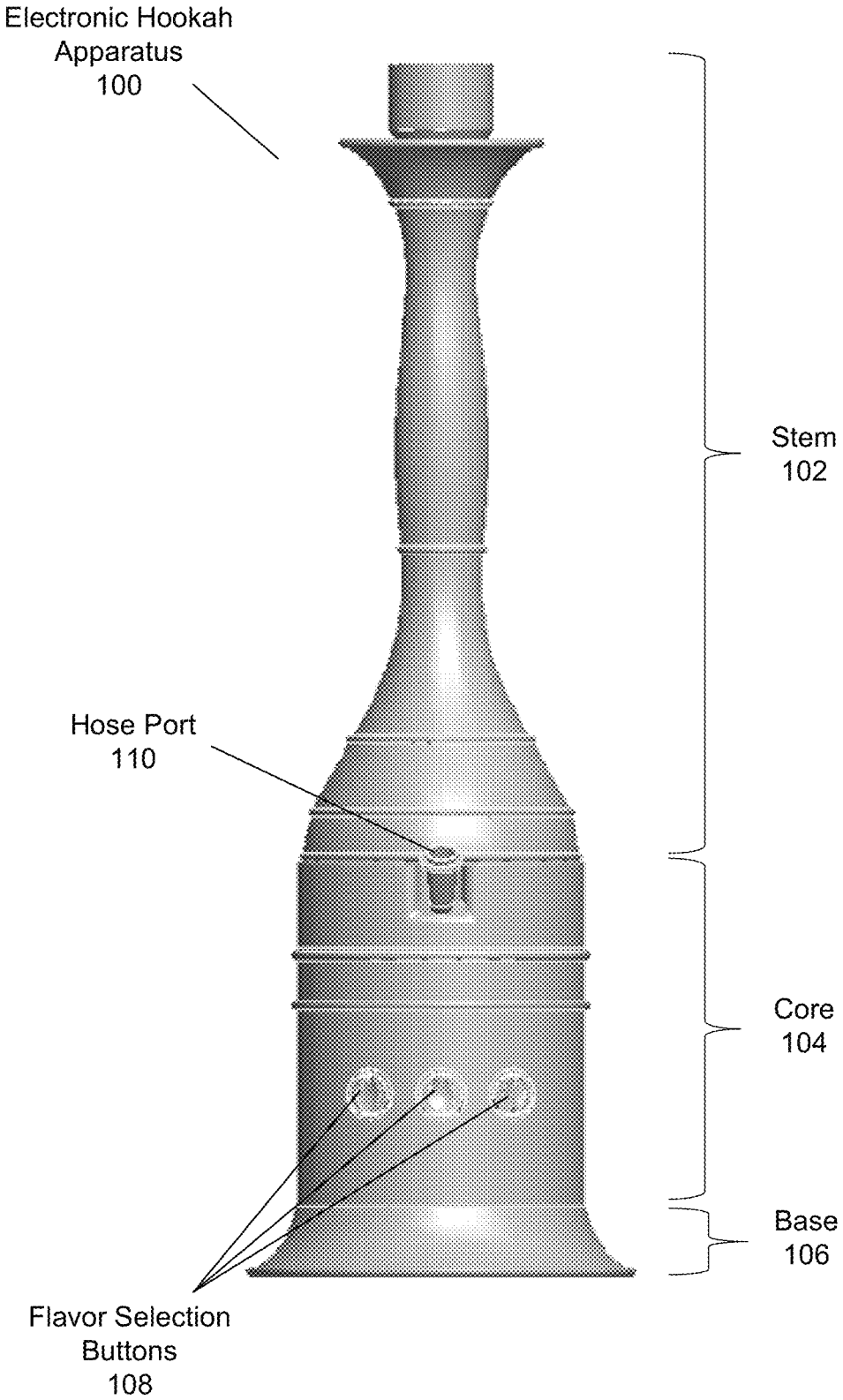
FIG. 1 illustrates an electronic hookah apparatus according to an embodiment of the present invention.

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

The present invention provides an electronic apparatus version of the traditional Middle Eastern hookah. The electronic hookah apparatus according to an embodiment of the invention utilizes one or more cartridges to produce smoke or vapor having one or more flavor characteristics. A cartridge may comprise a capsule, tank, or receptacle that is disposable, or otherwise, reusable containing a housing with an atomizer and a wick and/or cloth that is soaked with flavored and/or unflavored liquid. The wick may be cotton or any organic or synthetic material suitable for use in such an application. In one embodiment, a resistance heating wire (or any heating element) may run along the wick within the housing, and when powered electrically, the resistance wire heats up and evaporates a portion of the liquid. According to one embodiment, powering of the resistance wire (or heating of cartridge liquid) may be activated upon a detection of a negative air pressure condition created when a user inhales through an outlet, mouthpiece or a hose connected to a port of the electronic hookah apparatus. An airflow switch or sensor may detect pressure changes to control and/or switch an electrical current to the cartridge to heat up the resistance wire. In another embodiment, the powering and activation of a cartridge may be manually activated and controlled by depressing a flavor selection button. The electronic hookah apparatus is able to accommodate a plurality of users, each of whom will have the ability to select any combination of flavors (from cartridges) by depressing flavor selection buttons located on the electronic hookah apparatus.

FIG. 1 presents an electronic hookah apparatus 100 according to an embodiment of the present invention. Electronic hookah apparatus 100 includes a stem 102, core 104, and base 106. As illustrated, stem 102 is coupled to the top of core 104 and base 106 is coupled to the bottom of core 104. One or more of the stem 102 and base 106 of the electronic hookah apparatus 100 are detachable from core 104.

Figure 2:
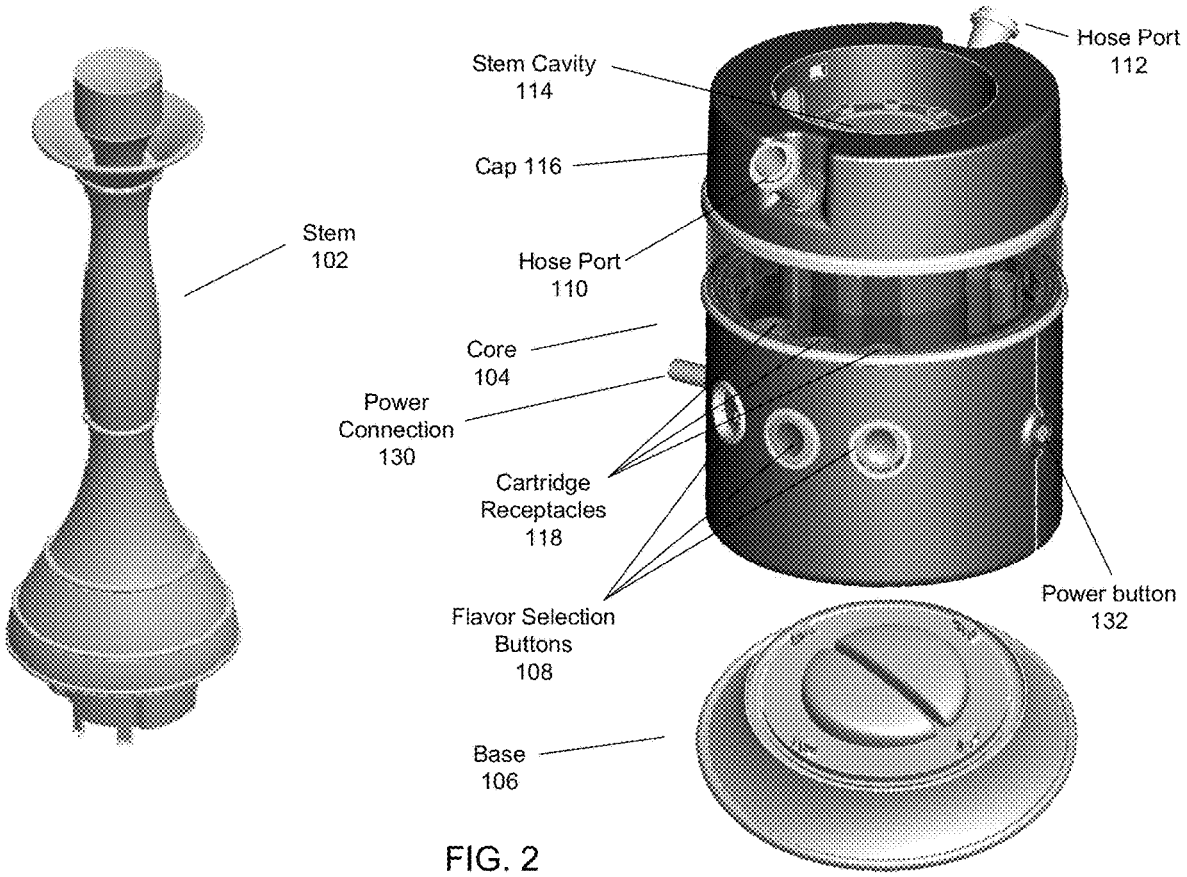
FIG. 2 illustrates components of the electronic hookah apparatus according to an embodiment of the present invention.

FIG. 2 provides a perspective view of the front, right and top view of the stem 102 and base 106 detached from core 104 of electronic hookah apparatus 100. Stem 102 may be but not limited to a decorative piece. It may be twisted, pushed, or otherwise adapted into the stem cavity 114 of the core 104. The stem 102 itself may comprise one or more components that can be fitted, glued or welded together. According to some embodiments, certain parts of the stem 102 may be hollow and constructed from clear or translucent material allowing for the visibility of light emitted from light-emitting diodes (LED) lights of the core 104.

According to the illustrated embodiment, the front and rear of the core 104 are identical or substantially identical. The core 104 comprises a main unit able to house electronic components and function without the stem 102 and base 106. To turn the core 104 on, the user may depress a power button 132 (e.g., on the side of the core 104). Core 104 includes flavor selection buttons 108 and hose port 110, hose port 112, stem cavity 114, and cap 116. Depressing a given one of flavor selection buttons 108 activates and deactivates an associated cartridge and optionally, at the same time, may create additional entryway for air. The air can enter the core through the space around the buttons, seams between components of the electronic hookah apparatus 100, and other air pathways into one or more chambers.

The air may flow into one or more cartridges inserted in cartridge receptacles 118. Any of cartridge receptacles 118 that have been activated by flavor selections buttons 108 may receive the air where it can be mixed with vapor/aerosol produced by cartridges placed in the activated cartridge receptacles. Air flow sensors may be installed in core 104 to detect the movement of air (when a user draws air from the hose ports) and determine when electrical current or power should be supplied to the activated cartridges. From the cartridge, the air and vapor/aerosol mixture can then be directed and collected to a mixing chamber and tapped by hose ports 110 and 112. The mixing chamber may be connected to one or more of the cartridges for mixing of various cartridge flavors/properties. The hose ports 110 and 112 may be adapted with a hose and/or mouthpiece (not illustrated) for consumption of the air and vapor/aerosol mixture.

According to embodiments of the present invention, one or more cartridges in cartridge receptacles 118 may be activated simultaneously. That is, user(s) may consume vapor from either a single cartridge or a plurality of cartridges from a given hose port, outlet or mouthpiece. For example, a first hose port may provide access to or tap from a chamber connected to a first set of cartridges and a second hose port may provide access to chamber connected to a second set of cartridges. According to an alternative embodiment, both the first and second hose ports may provide access to a single chamber connected to either or both sets of cartridges.

A cartridge can include liquids, flavors, chemicals, or other properties that may be mixed, combined, or selectively used. Cartridges used in embodiments of the present invention are not limited to cartomizers and may include any atomizer device and/or a substance delivery and container system. For example, a cartridge includes a heating element that heats or atomizes a liquid solution, otherwise known as e-liquid, containing chemicals such as propylene glycol, glycerin, nicotine, and flavorings. Cartridges (range of 0.01-5.0 ohm or any suitable range) may be powered with batteries (capable of 350 mAh or higher) or any suitable power source. Electronic hookah apparatus 100 may contain any number of cartridges, e.g., three on each of two sides (total of six), as presented in the illustrated embodiments. Each cartridge may be connected to any suitable prewired cartridge adaptor in the cartridge receptacles 118 for plugging cartridges into the core 104.

Base 106 may be connected to the bottom of the core 104. Similar to the stem 102, base 106 can be a decorative piece but may include additional features. For example, base 106 may have a modular connection in a form of a pogo pin which, when connected to the core, provides an electrical connection to power a set of LEDs integrated into its design. The set of LEDs may become active when the base 106 is connected to the core 104.

Core 104 further includes power connection 130 that supplies power to the core 104 from a wire connection to an AC/DC power source or outlet. The electronic hookah apparatus 100 is operable on either a rechargeable battery unit or alternating current/direct current (AC/DC) power using a direct power source (such as a wall outlet), or both while charging the battery unit. The battery unit used by electronic hookah apparatus 100 may be rechargeable when it is connected to the direct power source. Any appropriate AC/DC converter may be used for operation of the electronic hookah device with a direct power source. The AC/DC converter may be plugged into power connection 130 or a Universal Serial Bus (USB) receptacle (not illustrated) on a printed circuit board (PCB) housed in the core 104.

According to one embodiment, the power button 132 may include an LED light integrated into it operable to indicate battery status. For example, when power connection 130 is un-plugged, the power button 132 displaying a red light may indicate a low charge (under battery operation) and green light may indicate normal charge. When power connection 130 is plugged into a power source, a blinking green light may indicate that the battery unit is charging and a solid green may indicate that the battery is fully charged.

Figure 3:
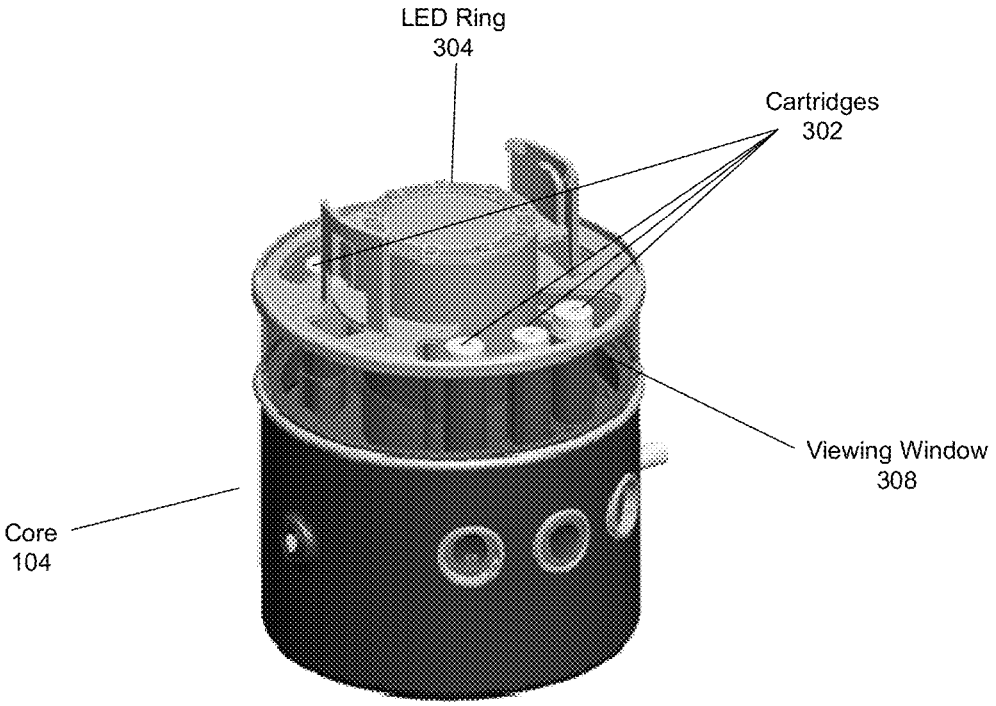
FIG. 3 illustrates an exposed view of the core of the electronic hookah apparatus according to an embodiment of the present invention.

FIG. 3 illustrates an exposed view of the core of the electronic hookah apparatus according to an embodiment of the present invention. An exemplary view of the core with the removable cap 116 removed is presented. Cap 116 may be removed for accessing and changing the cartridges 302 from cartridge receptacles 118. As described herein, the electronic hookah apparatus 100 may contain several sets of programmable red, green, blue, etc., LEDs controlled by a processing device such as a microprocessor. LED ring 304 may be housed towards the top of the core 104 to project light into stem 104. LED ring 304 may be wrapped under viewing window 308. Another set of LEDs may located on the base 106 (not illustrated), and may become active when the base 106 is connected to the core 104.

The base 106 may further include programmable logic or circuitry able to cause display of one or more LED colors. Color schemes of the LEDs within the electronic hookah apparatus 100 may be configured simultaneously and/or individually. LED's may be configured on a circuit board and project light through to various buttons and ornamental components. The user may have the ability to change which color is lighted on via programming of logic or by a selector switch on core 104. In some embodiments, the flavor selection buttons 108 include individual colored LEDs that may be located behind each of the flavor selection buttons and light up when the button is depressed or when a given cartridge is in operation. According to another embodiment, the flavor selection buttons may include self-containing lighting mechanisms.

According to one embodiment, when the core 104 is initially powered on via power button 132, LEDs may emit light at a low glow or brightness. As a user starts to inhale or draw air from a hose port (outlet or mouthpiece), an air flow sensor may detect the air flow and signal to a microprocessor to cause the LEDs to increase in brightness, and dim back or return to the low glow when the air stops flowing (or determined cease of usage or any other predetermined event). In another embodiment, LEDs of the electronic hookah apparatus 100 may be programmed to produce a pulse glow effect. The pulse glow effect may intermittently dim and brighten LEDs after a predetermined amount of time (e.g., a few minutes) of non-use (e.g., no airflow detected by airflow sensor) to draw attention to the apparatus. The color brightness scheme may be the same and/or constant for all or a selective few of the LEDs on electronic hookah apparatus 100.

Figure 4:
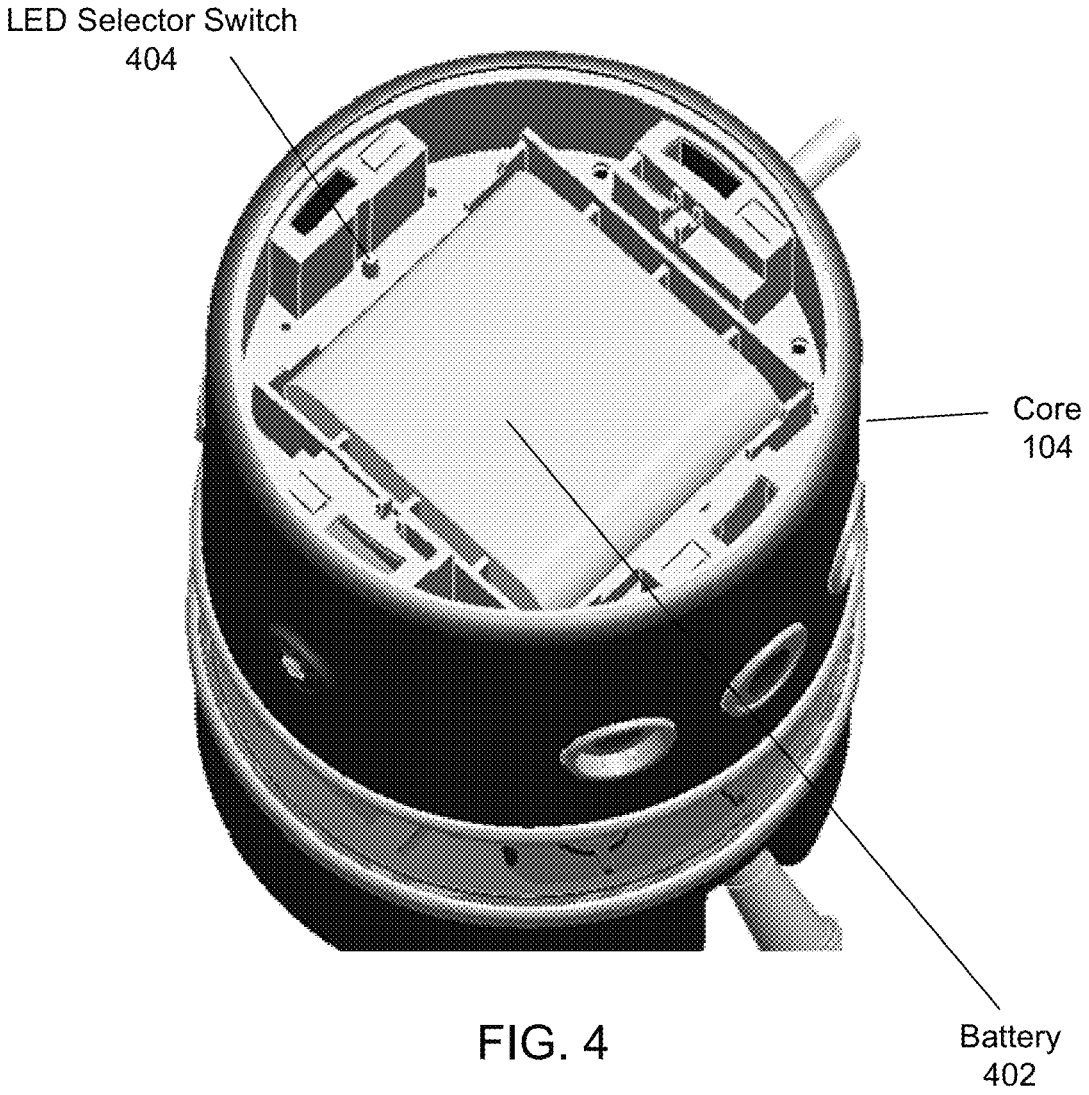
FIG. 4 illustrates a bottom view of the core of the electronic hookah apparatus according to an embodiment of the present invention.

FIG. 4 illustrates a bottom view of the core of the electronic hookah apparatus according to an embodiment of the present invention. Removal of base 106 from the bottom of core 104 exposes a PCB compartment including a battery 402 and LED selector switch 404. LED selector switch allows a user the ability to change which color is lighted on the LEDs. Battery 402 may comprise a battery pack unit including one or more cells producing an appropriate amount of voltage and current to power electronic hookah apparatus 100.

Figure 5:
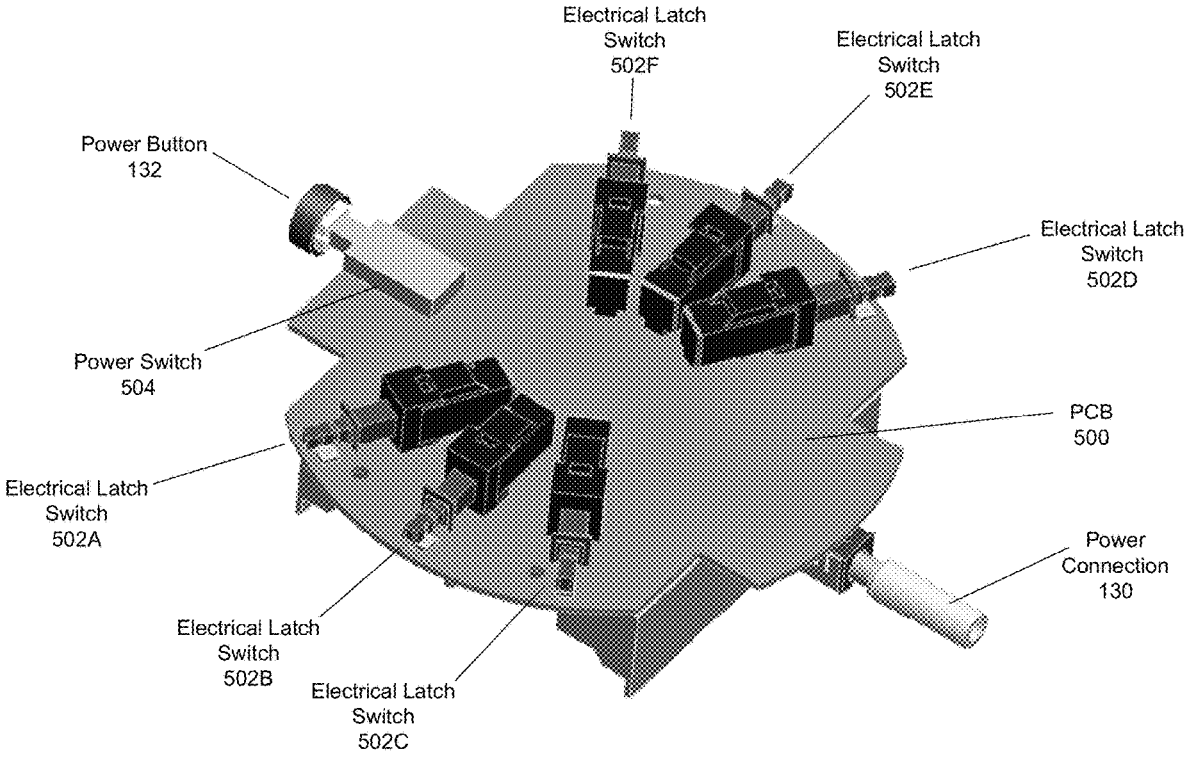
FIG. 5 illustrates a circuit board of the core of the electronic hookah apparatus according to an embodiment of the present invention.

FIG. 5 presents a PCB 500 housed under the core of the electronic hookah apparatus according to an embodiment of the present invention. PCB 500 includes electrical latching switches 502A, 502B, 502C, 502D, 502E, and 502F, power switch 504, and power connection 130. Each of flavor selection buttons 108 is connected to one of the electrical latching switches 502. Power button 132 is connected to power switch 504. PCB 500 further includes electronic and circuitry components (not illustrated) such as resistors, diodes, capacitors, transistors, resisters, programmable logic devices, processors, and memory chips.

The components of the PCB 500 (e.g., microprocessor) may control and regulate a plurality of functionalities of the electronic hookah apparatus 100 simultaneously such as battery charging and power control. For example, a microcontroller of the PCB 500 is operable to manage operation of the product, power management features, battery charging functions, and operation of a plurality of cartridges to be used simultaneously. Signals from air flow sensors may be monitored by the microcontroller to determine when to supply power to the cartridges (via connectors). A microcontroller on PCB 500 may also provide settings to control voltages to cartridges. Voltage control can be used to affect usage of one or more cartridges. Varying and controlling voltages at each cartridge may be used to change the intensity of vapor from each cartridge to control flavor and the amount of smoke produced by the electronic hookah apparatus 100. For example, if six cartridges are selected, a user may change the voltage for each cartridge to control the appropriate amount of vapor from each cartridge to produce a desired smoke combination. Another power management feature may include limiting duration of time that power is supplied to the cartridges (e.g., 10 seconds). If that limit is reached, the electronic hookah apparatus 100 may indicate such by flashing LEDs several times. However, in alternative embodiments, air flow sensors and microcontrollers may be omitted in lieu of activation and control of cartridges by manual control (e.g., electronically configured via a user interface, or by buttons and switches).

Battery power level and temperature may also be monitored. For example, electronic hookah apparatus 100 may be shut down when the battery voltage is below a certain level to conserve the batteries or when the temperature of the battery is above a certain threshold to prevent damage. An indication that the electronic hookah apparatus 100 is charging may also be controlled by slowly flashing green by the LED in the Power Button. Similarly, providing an indication that the unit is charged may be accomplished by a solid green light on the LED in the Power Button. An indication that the batteries low can be indicated by showing a red LED in the Power Button.

Electronic hookah apparatus 100 may include additional components controllable via the PCB 500 such as liquid crystal display (LCD) screens, speakers, multimedia devices elctromechanical devices, and/or vibrating mechanisms or devices to provide display features and effects (lighting, video, audio, and physical). Exemplary effects may include bubbling of water, fire burning, flashing, smoking or misting, animations, moving text and characters, etc.

Figure 6:
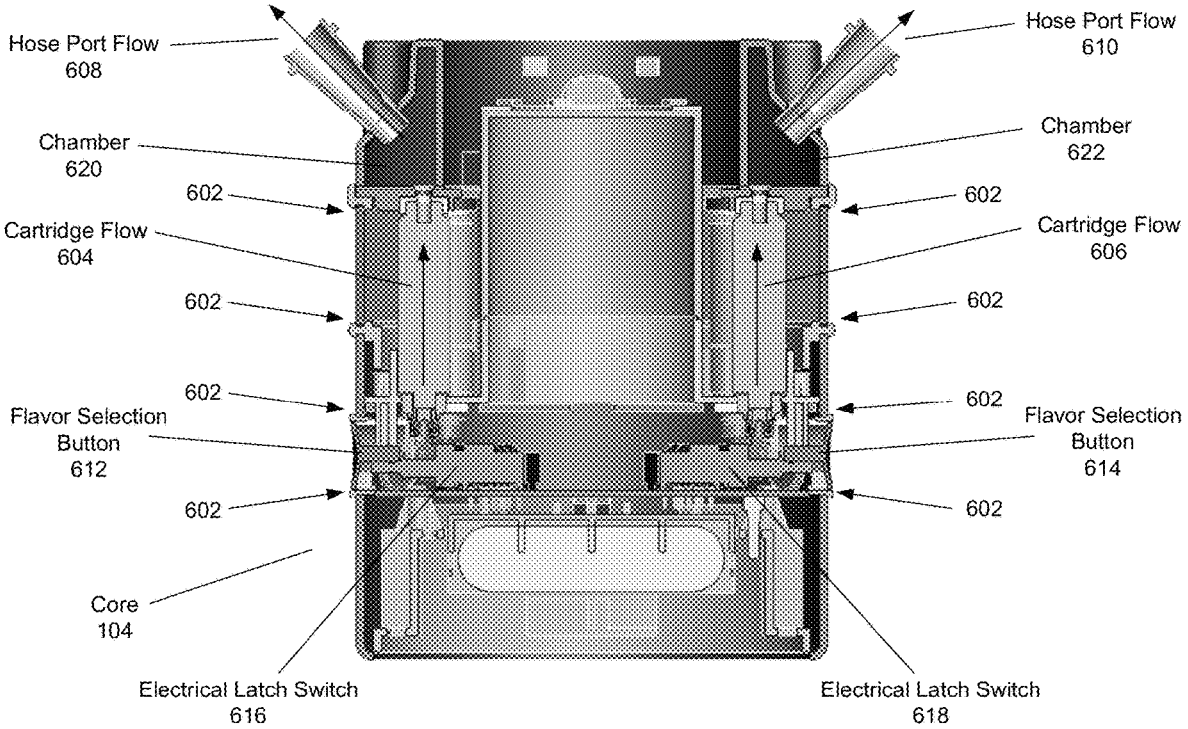
FIG. 6 illustrates a cross-section of the core of the electronic hookah apparatus according to an embodiment of the present invention.

FIG. 6 illustrates a cross-section of the core of the electronic hookah apparatus according to an embodiment of the present invention. Air can flow into core 104 towards individual cartridges from air pathways 602. It is noted that air pathways 602 are merely exemplary illustration of some but not all pathways that air may enter into core 104. Air flow (drawn out of hose ports or drawn in through air pathways 602) may be sensed by one or more pressure sensors inside the core 104. For example, core 104 may include two sensors that monitor individual hose port flow 608 and hose port flow 610. When the airflow is detected, electrical current (or heat) to activated/selected cartridges are turned on. The air from air pathways 602 can individually flow from cartridge flow 604 and cartridge flow 606 to chamber 620 and chamber 622, respectively, to mix with vapors produced by all activated cartridges connected to the chambers. The combination of air and vapor mixture may then flow out of hose ports in hose port flows 608 and 610. Flavor selection button 612 and flavor selection button 614 are connected to electrical latching switch 616 and electrical latching switch 618, respectively. When depressed, electrical latching switch 616 and electrical latching switch 618 control current flow to their associated cartridges/cartridge heater for consumption.

The electronic hookah apparatus 100 may be provided according to a plurality of versions, models, or themes. For example, a "home" version may include a configuration of the electronic hookah apparatus 100 comprising a core, stem and base. In another example, a "venue" version may include a configuration of the electronic hookah apparatus 100 comprising the core without a stem and/or base. Instead, a decorative cap 116 may be adapted to the top of the core in the stem cavity. In a further embodiment, a "venue" version of the apparatus may be situated in a basket, bracket or holding mechanism in conjunction with a table (e.g., under the table or in a compartment).

Embodiments of the present invention may comprise a hookah form but is not limited to traditional hookah shaped devices exclusively. For example, other embodiments of the present invention may include a pen, pipe, bong or any other electronic smoking apparatus that produces vapor or smoke via a multiple-smoke/vapor producing-chamber and/or pathway/cartridge/component activation that allows the user to have multiplicity control, wherein multiplicity control allows for the utilization or deactivation of any or all or none of the smoke/vapor producing chambers/pathway/cartridge/component.

FIGS. 1 through 6 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

The invention claimed is:

1. A method for controlling vapor in an electronic smoking device, the method comprising:

detecting at least one signal associated with a selection of at least one of a plurality of flavor selection buttons on the electronic smoking device, the electronic smoking device including a plurality of cartridges, a plurality of receptacles, and a first air chamber, wherein individual pathways connect each of the receptacles to the first air chamber, each of the cartridges is inserted into one of the plurality of receptacles, and wherein each of the plurality of receptacles is associated with one of the plurality of flavor selection buttons such that given ones of the receptacles are activated by selecting corresponding ones of the plurality of flavor selection buttons;

activating each respective cartridge associated with the selection of at least one of the plurality of flavor selection buttons;

providing heat to each of the activated cartridges to cause the cartridge to produce vapor; and mixing in the first air chamber the vapor collected from each of the activated cartridges via the individual pathways from each of the activated receptacles with the activated cartridges inserted therein.

2. The method of claim 1 further comprising, electronically varying voltages supplied to each activated ones of the plurality of cartridges to change intensity of vapor from each of the activated ones of the plurality of cartridges.

3. The method of claim 1 further comprising, electronically controlling programmable light emitting diodes (LEDs) of the electronic smoking device.

4. The method of claim 3 wherein the electronic smoking device further includes the programmable LEDs each associated with one of the plurality of flavor selection buttons, and wherein electronically controlling programmable LEDs of the electronic smoking device further includes causing the LEDs associated with the activated cartridges to increase in brightness from an initial brightness based on a detection of usage of the electronic smoking device and return to the initial brightness based on a detection of non-usage of the electronic smoking device.

5. The method of claim 3 wherein the electronic smoking device further includes the programmable LEDs each associated with one of the plurality of flavor selection buttons, and wherein electronically controlling programmable LEDs of the electronic smoking device further includes causing the LEDs associated with the activated cartridges to intermittently dim and brighten after a predetermined amount of time.

6. The method of claim 1 further comprising, electronically varying voltages supplied to each of the activated cartridges to control flavor and the amount of smoke produced from each of the activated cartridge to produce a desired smoke combination.

7. The method of claim 1 further comprising, electronically controlling vapor from given sets of the activated cartridges to a given air chamber.

8. The method of claim 7 further comprising, electronically controlling a plurality of port access to the given air chamber.

9. The method of claim 1, wherein the electronic smoking device includes a core structure, the plurality of receptables are housed in the core structure, and wherein the first air chamber is detachably coupled to the core structure, the method comprising detaching the first air chamber from the core to expose the plurality of cartridges and inserting the plurality of air cartridges into respective receptables.

10. The method of claim 9, wherein the plurality of cartridges are arranged circularly about a center of the core structure.

* * * * *